US008534941B2

(12) United States Patent
Takayama

(10) Patent No.: US 8,534,941 B2
(45) Date of Patent: Sep. 17, 2013

(54) EXPANDING A SHEET TO BE CUT WHEN AN INK DOT IS PRESENT IN A CUT POSITION

(75) Inventor: Shoji Takayama, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 49 days.

(21) Appl. No.: 13/418,519

(22) Filed: Mar. 13, 2012

(65) Prior Publication Data

US 2012/0243049 A1 Sep. 27, 2012

(30) Foreign Application Priority Data

Mar. 22, 2011 (JP) ..... 2011-062160

(51) Int. Cl.
*B41J 29/42* (2006.01)

(52) U.S. Cl.
USPC ..... 400/342; 358/1.18; 358/1.2; 400/621; 400/621.1

(58) Field of Classification Search
USPC ..... 358/1.18, 1.2; 400/64, 342, 611, 400/612, 621, 621.1
See application file for complete search history.

(56) References Cited

U.S. PATENT DOCUMENTS

2003/0077099 A1 * 4/2003 Tanaka et al. ..... 400/615.2

FOREIGN PATENT DOCUMENTS

JP 2003-341161 12/2003
JP 2004-001312 1/2004

* cited by examiner

*Primary Examiner* — Eric A Rust
(74) *Attorney, Agent, or Firm* — ALG Intellectual Property, LLC

(57) ABSTRACT

A printing apparatus has: a dot discrimination section that discriminates whether a print dot is present in a discrimination target area D including a cut position at which an elongated sheet is cut in a sheet width direction, the discrimination target area being at least either one of a front edge area D1 or a rear edge area D2 having a predetermined length in a longitudinal direction of the sheet in a print area; and a print section that prints after providing a margin area adjacent to an outer side of either one of the front edge area or the rear edge area where whether the print dot is present or not is discriminated when the dot discrimination section discriminates such that the dot is present, and that prints without providing the margin area when the dot discrimination section discriminates such that the dot is not present.

12 Claims, 9 Drawing Sheets

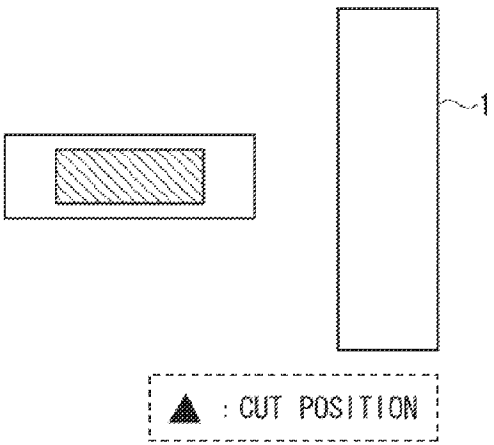
FIG. 3A
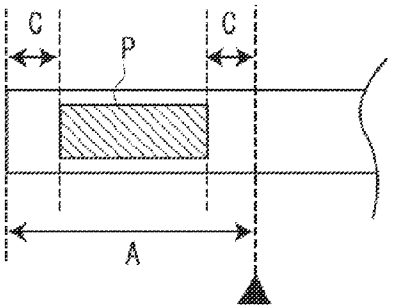
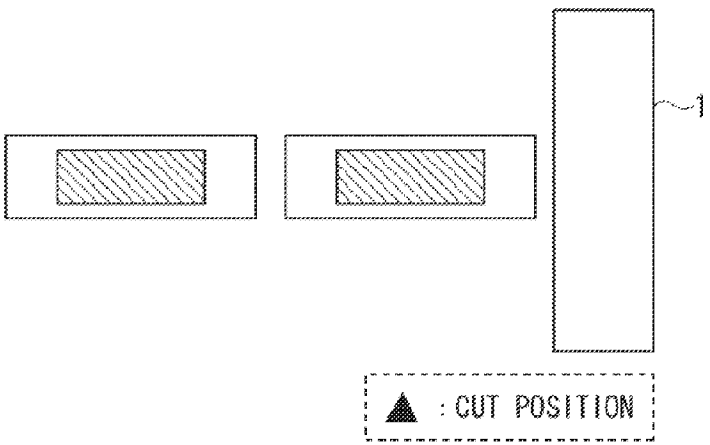
FIG. 3B
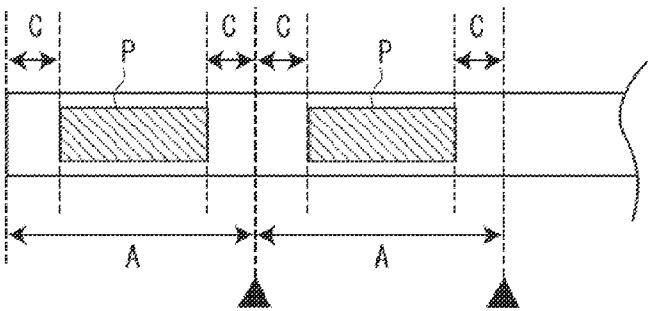

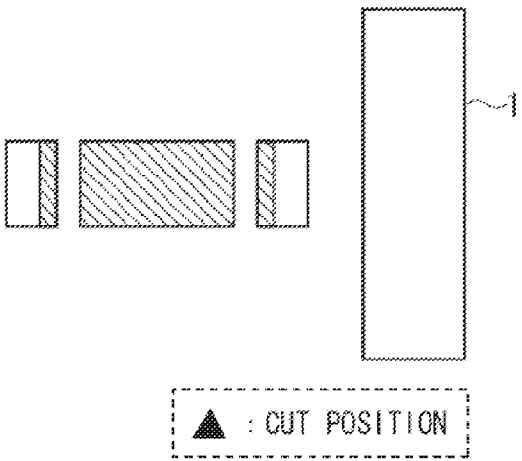
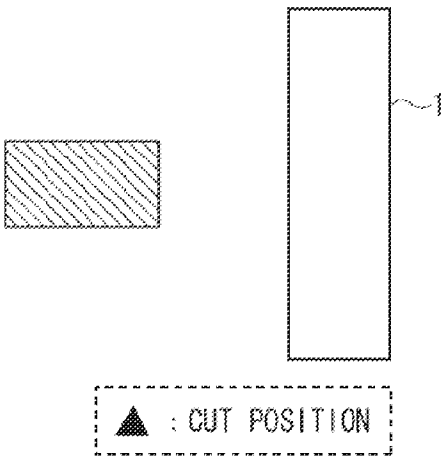
FIG. 5A
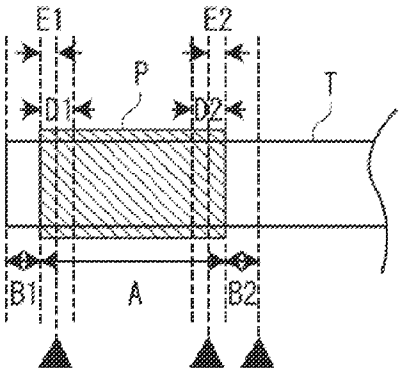
FIG. 5B
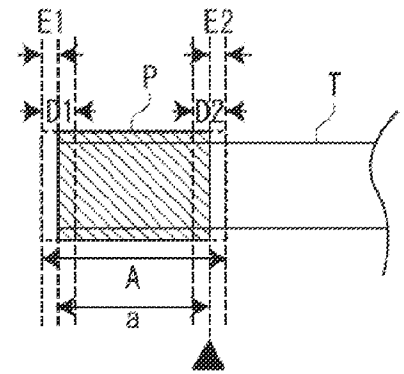

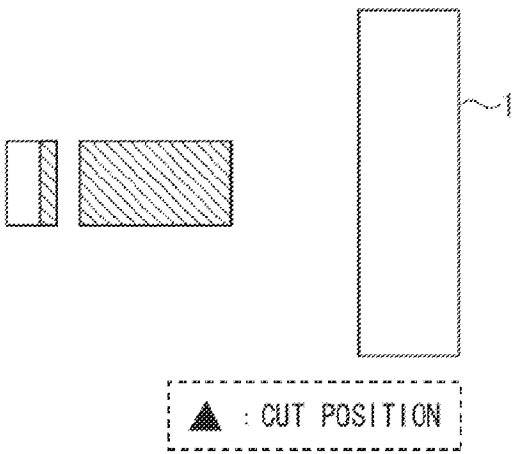
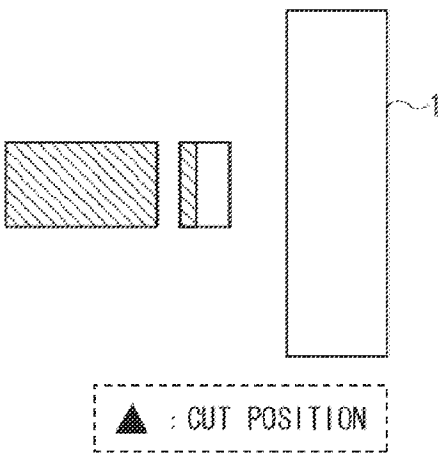
FIG. 6A
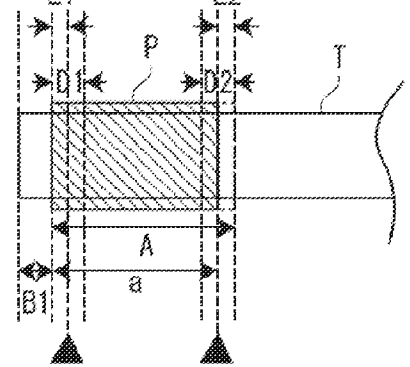
FIG. 6B
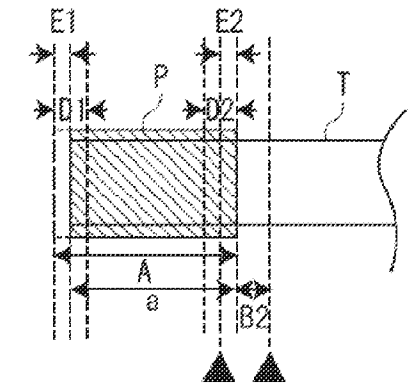

EXPANDING A SHEET TO BE CUT WHEN AN INK DOT IS PRESENT IN A CUT POSITION

The entire disclosure of Japanese Patent Application No. 2011-062160, filed on Mar. 22, 2011, is expressly incorporated by reference herein.

BACKGROUND

1. Technical Field

The present invention relates to a printing apparatus which is capable of performing marginless printing at least in a longitudinal direction of an elongated sheet and a method of controlling the same.

2. Related Art

Generally, a printing apparatus described above prints beyond or out of a desired print area in a sheet, and then performs a cut process by which an out-of-portion is cut off from the desired print area (for example, see JP-A-2003-341161). The printing apparatus disclosed in JP-A-2003-341161, first of all, cuts a boundary between the out-of-portion printed on a rear edge of the sheet in the longitudinal direction and the desired print area as this kind of cut process, and cuts an area including the out-of-portion remained on the sheet in preparation for next printing. In the cutting process, the printing apparatus calculates an out-of-amount of the rear edge portion based on a sheet size and an image size to be printed and decides two cut positions in consideration of the out-of-amount. The printing apparatus achieves marginless printing by printing outside a front edge of the sheet.

The printing apparatus above cuts the area including the out-of-portion, that is, performs a rear cut process in preparation for the next printing. Such a rear cut process must generate a sheet piece to be thrown away besides a label itself. However, in a case that printing dots are not actually present in the area of the out-of-portion in the print area, the unnecessary sheet piece which should not be generated must be generated, thereby wasting the sheet.

SUMMARY

Therefore, it is an advantage of the invention to provide a printing apparatus which is capable of reducing unnecessary waste of sheet in the marginless printing in the longitudinal direction of the sheet and a method of controlling the same.

In one aspect of the invention, there is provided a printing apparatus having: a dot discrimination section configured to discriminate whether a print dot is present in a discrimination target area including a cut position at which an elongated sheet is cut in a width direction, the discrimination target area being at least either one of a front edge area or a rear edge area having a predetermined length in a longitudinal direction of the sheet in a print area based on print data; and a print section configured to print after providing a margin area adjacent to an outer side of either one of the front edge area or the rear edge area where whether the dot is present or not is discriminated when the dot discrimination section discriminates such that the dot is present, and that prints without providing the margin area when the dot discrimination section discriminates such that the dot is not present.

In the other aspect of the invention, there is provided a method of controlling a printing apparatus, the printing apparatus executing steps of: discriminating whether a print dot is present in a discrimination target area including a cut position at which an elongated sheet is cut in a sheet width direction, the discrimination target area being at least either one of a front edge area or a rear edge area having a predetermined length in a longitudinal direction of the sheet in a print area based on print data; and printing after providing a margin area adjacent to an outer side of either one of the front edge area or the rear edge area where whether the dot is present or not is discriminated when the discrimination step discriminates such that the dot is present, and printing without providing the margin area when the discrimination step discriminates such that the dot is not present.

With these configurations, since the margin area is provided adjacent to the outer side of the print area only when the print dot is present in the area including the cut positions in the front edge area and the rear edge area of the print area, an unnecessary area of the sheet is generated only when the print dot is actually present beyond a desired area. In other words, since the unnecessary area of the sheet is not generated when the dot is not actually present beyond the desired area, it is possible to limit waste of sheet in marginless printing. Since it is possible to securely print on the sheet from the front edge of the print data by providing the margin area adjacent to the front edge area when the print dot is actually present, an inside of the tape printing apparatus can not be soiled by printing on the outside the sheet. Further, by providing the margin area adjacent to the rear edge area, an out-of-portion can not be adjacent to the print area for next printing.

It is preferable that the apparatus further have a cut section configured to cut the sheet in the sheet width direction at the cut position.

It is preferable that the cut section further cut a rear edge of the margin area provided at an outer side of the rear edge area when the rear edge area of the print area is discriminated such that the dot is present by the dot discrimination section.

With these configurations, only when the print dot is actually present beyond the desired area in the rear edge portion of the print area, a sheet piece as garbage is generated.

It is preferable that the print section print continuously based on plurality of print data, and the dot discrimination section discriminate whether the dot is present in the discrimination target area in the print area based on each print data.

It is preferable that the print section provide the margin area adjacent to adjacent discrimination target areas in common when both of the adjacent discrimination target areas are discriminated such that the dot is present by the dot discrimination section in the continuous printing.

With these configurations, it is possible to limit waste of sheet by having the margin area as unnecessary area of the sheet in common in the continuous printing.

It is preferable that the printing apparatus further have a print data edit section configured to delete data at an outer side of the cut position of the discrimination target area in either one of the front edge area or the rear edge area discriminated such that the dot is not present from the print data when the dot discrimination section discriminates such that the dot is not present.

With this configuration, when the dot discrimination section discriminates such that the dot is not present, since the cut position corresponds to the front edge of sheet in the front edge area, the cutting is not necessary. Further, since the cut position corresponds to the rear edge of the print area in the rear edge area, next printing is not incurred in the continuous printing. In other words, it is possible to avoid that a next print area is offset to backwards and is printed in a state that the print area having no print dot in previous printing remains at the front edge portion of the sheet in the continuous printing.

BRIEF DESCRIPTION OF THE DRAWINGS

FIG. 3A illustrates views of a print area to be set and a label to be created in single printing of normal printing schematically, and FIG. 3B illustrates views of print areas to be set and labels to be created in continuous printing schematically.

FIG. 5A illustrates views of the print area to be set and the label to be created when it is discriminated that the dot is present in the single printing of marginless printing schematically, and FIG. 5B illustrates views of the print area to be set and the label to be created when it is discriminated that the dot is not present schematically.

FIG. 6A illustrates views of the print area to be set and the label to be created when it is discriminated that the dot is present on a front edge discrimination target area and FIG. 6B illustrates views of the print area to be set and the label to be created when it is discriminated that the dot is present on a rear edge discrimination target area, in the single printing of the marginless printing schematically.

DESCRIPTION OF EXEMPLARY EMBODIMENTS

A printing apparatus and a method of controlling the same according to one embodiment of the invention will be described with reference to the accompanying drawings. In the embodiment, the invention is applied to a tape printing apparatus which prints and cuts a tape (sheet) to create a label. The printing apparatus can execute "normal printing" in which a margin is provided on a printed surface of a created label and "marginless printing" in which the margin is not provided on the printed surface of the created label.

Figure 1:
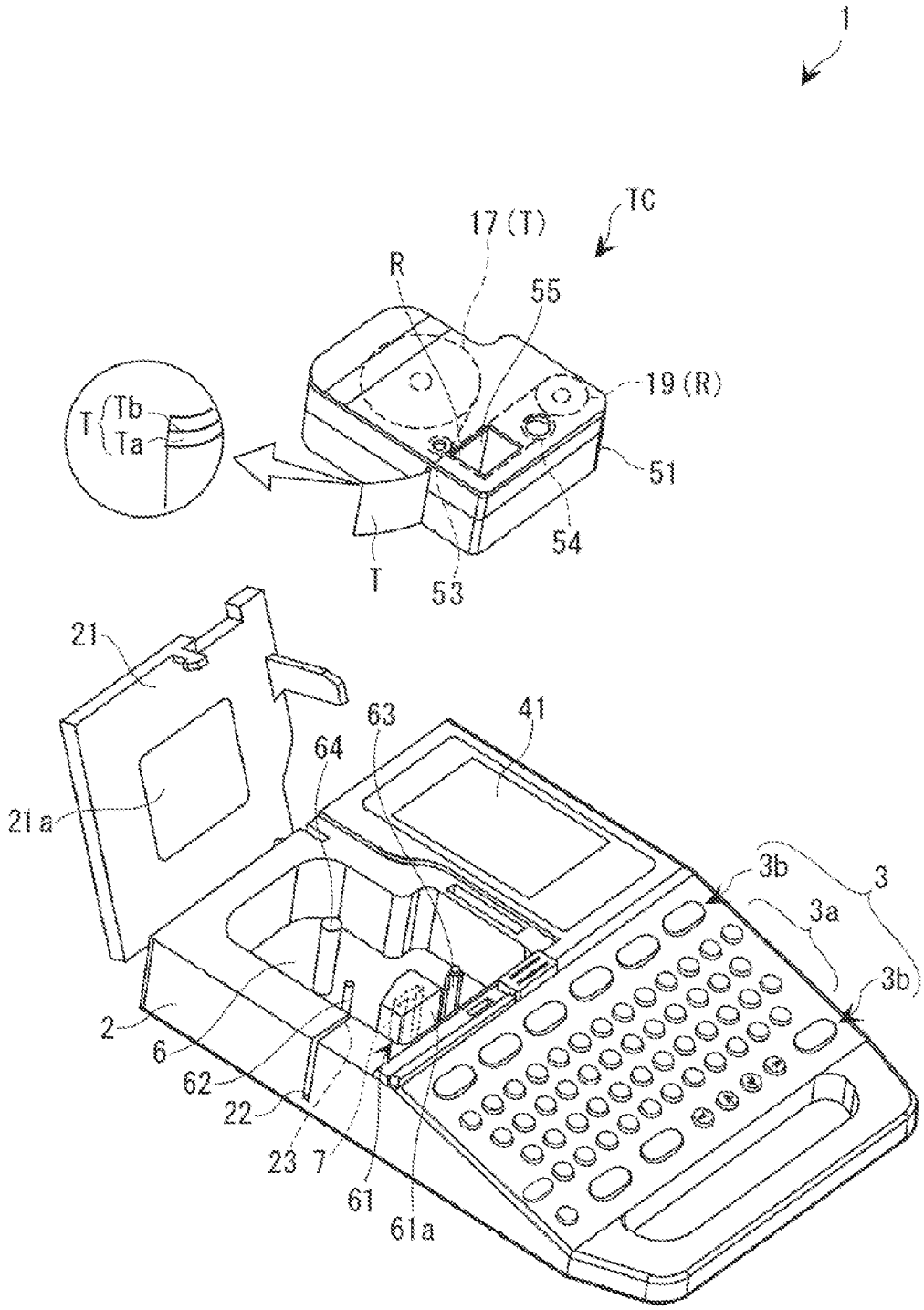
FIG. 1 is an appearance perspective view of a tape printing apparatus according to an embodiment of the invention.

FIG. 1 is an external perspective view of a tape printing apparatus 1 according to the embodiment in a state that an opening and closing cover 21 thereof is opened. As illustrated, an external shape of the tape printing apparatus 1 is formed by a case 2. On a front upper portion of the case 2, a keyboard 3 including various input keys is disposed. On a left side of a rear upper portion thereof, the opening and closing cover 21 is provided and on a right side thereof, a display screen 41 is provided.

Inside the opening and closing cover 21, a cartridge mount section 6 for mounting a tape cartridge TC is formed in a hollow shape. The tape cartridge TC is detachably mounted in the cartridge mount section 6 with a state in which the opening and closing cover 21 is opened. Moreover, in the opening and closing window 21, there is formed an observation window 21*a* used for viewing the mounting/non-mounting of the tape cartridge TC with a state in which the opening and closing cover 21 is closed.

On the keyboard 3, a character key group 3*a* and a function key group 3*b* for assigning various operating modes and the like are arranged. The character key group 3*a* has a full key arrangement based on, e.g. Japanese Industrial Standards (JIS) sequence and may include a shift key for preventing the increase of the number of keys to be operated, similar to a general word processor or the like. Moreover, the function key group 3*b* may include: a [cursor] key, a [select] key, a [delete] key, a [print] key, a [continue] key, a [format setting] key, a [environmental setting] key, and the like, for example.

The cursor key includes an up (↑), a down (↓), a left (←), and a right (→) keys and each of which is used for cursor movement and scroll operations. The [select] key and the [delete] key are used for information input and various settings. The [print] key is used for instructing print execution.

The [continue] key is used for continuous printing by which a plurality of same labels are printed. In the embodiment, the continuous printing can be set by pressing the [continue] key. A structure such as sequential number printing may be employed, thereby, a plurality of labels of which only a portion such as a number is different may be sequentially printed by pressing the [continue] key.

The [format setting] key is used for various settings for editing the print data. In the embodiment, a margin setting can be made by pressing the [format setting] key. The margin setting decides length of margins (referred as a label margin C hereinafter) provided on both edges of a single label to be created. In other words, the created label has combined length of a label image P edited by a user and the label margins C provided on the both edges in a tape longitudinal direction of the label image P (see FIG. 3A). In the margin setting in the embodiment, for example, either one of "no margin (label margin C: 0 mm)", "minimum (label margin C: 1 mm)", "smaller (label margin C: 9 mm)", "normal (label margin C: 12 mm)", and "larger (label margin C: 18 mm)" can be selected by pressing the [format setting] key. In a case that the "no margin (label margin C: 0 mm)" is selected, the tape printing apparatus 1 executes the "marginless printing" by which a margin is not provided on the printed surface of the label (details thereof are described later). Further, in the embodiment, in a case that the "minimum (label margin C: 1 mm)" is selected, the tape printing apparatus 1 cuts a front edge of the label margin C provided outside a front edge of the label image P. This is because that the tape printing apparatus 1 does not have a reverse function of a tape T even though the length (1 mm) of the label margin C is shorter than distance between a cutter and a print head of the tape printing apparatus 1.

The [environmental setting] key is used for various environmental settings. In the embodiment, a cutting function can be set by pressing the [environmental setting] key. Whether full cutting or half cutting should be executed at a cutting position is selected by the setting of the cutting function.

The display screen 41 is a liquid crystal display and is used for confirming an edit result based on input information input via a keyboard 3 by the user and the print data and the like generated based on the edit result.

At the left side of the case 2, a tape ejecting slot 22 is formed which communicates the cartridge mount section 6 with outside. A tape cutter 23 for cutting off the tape (tape-like material) T fed by a tape feeding mechanism (not shown) faces to the tape ejecting slot 22. A predetermined length of the printed tape T is transmitted from the tape ejecting slot 22 and the printed tape T is cut off with the tape cutter 23 in a state that the transmission is in halt, thereby a strip-like label is formed.

The cartridge mount section 6 has a head unit 61 having a thermal type print head 7 in a head cover 61*a*, a platen drive shaft 62 facing to the print head 7, a take-up drive shaft 63 for taking up a later described ink ribbon R, and a positioning boss 64 for a later described tape reel 17. At the lower side of the cartridge mount section 6, a tape feeding motor 26 (see FIG. 2) is provided by which the platen drive shaft 62 as the tape feeding mechanism and the take-up drive shaft 63 are rotated.

The tape cartridge TC has a tape reel 17 wound with the tape T having a given width (e.g. about 4 mm-48 mm) at the upper center portion inside the cartridge case 51, and a ribbon reel 19 wound with the ink ribbon R at the right lower portion thereof. The tape T and the ink ribbon R have the same width. A through opening 55 is formed in which a head cover 61*a* covering the head unit 61 is inserted at the left lower portion of the tape reel 17. The head unit 61 inserted in the through opening 55 and the platen roller 53 which is engaged with the platen drive shaft 62 to be rotated are disposed to correspond a portion where the tape T and the ink ribbon R overlap. A ribbon take-up reel 54 is disposed in conjunction with the ribbon reel 19. The ink ribbon R drawn out from the ribbon reel 19 is wound up on the ribbon take-up reel 54 so as to surround the head cover 61*a*. In short, the ink ribbon R is wound up on the ribbon take-up reel 54 by way of a ribbon path on the peripheral wall of the through opening 55.

When the tape cartridge TC is mounted on the cartridge mount section 6, the through opening 55 is inserted on the head cover 61*a*, the center hole of the tape reel 17 is inserted on the positioning boss 64, and the center hole of the ribbon take-up reel 54 is inserted on the take-up drive shaft 63, respectively. The print head 7 comes in contact with the platen roller 53 to sandwich the tape T and the ink ribbon R, leading to be capable of printing. Then, the user inputs a desired text (a character, a number, a symbol, a character of a simplified graphic or the like) or an image (the label image P hereinafter) with the key board 3 while checking the edit result displayed on the display screen 41. When an instruction for printing is given by pressing the [print] key (in the normal printing), the tape printing apparatus 1 draws out the tape T from the tape cartridge TC with the tape feed motor 26 and prints as desired on the tape T by printing action in which heater elements of the print head 7 are selectively heated. A printed portion of the tape T is transmitted to an outside via the tape ejecting slot 22 on occasion. After the printing completes, the tape feed motor 26 transmits the tape T to a position of a tape length including the label margin C and stops the transmission. Then, the tape T is cut off in the tape width direction with the tape cutter 23 (a full cutter 31 or a half cutter 32) driven by a cutter motor 25 (a full cutter motor 33 or a half cutter motor 34 (see FIG. 2)).

The "print data" in claims indicates the desired input text (the character, the number, the symbol, the character of the simplified graphic or the like) or information based on the edit result of the image and the margin setting, and a "print area" includes the label image P and the label margin C (see FIG. 3A).

The tape T has a recording tape Ta formed with an adhesive layer on the back side thereof and a peeling tape Tb adhered to the recording tape Ta by the adhesive layer. The tape T is contained in the cartridge case 51 in a state that the tape T is wound in a roll fashion having the recording tape Ta outwardly and the peeling tape Tb inwardly. Various types (a tape width, a base color, a background image, material (texture) and the like) of tapes T are prepared, and each of the cartridge cases 51 includes one type of the tapes T (and the ink ribbon R). At the rear side of the cartridge case 51, a plurality of holes (not shown) are formed by which the type of the tape cartridge TC is specified. A plurality of tape discrimination sensors (for instance, micro switches) 27 (see FIG. 2) for detecting the holes are provided in the cartridge mount section 6 corresponding to the plurality of holes. The tape type can be discriminated by detecting states of the plurality of holes with the tape discrimination sensors 27.

Figure 2:
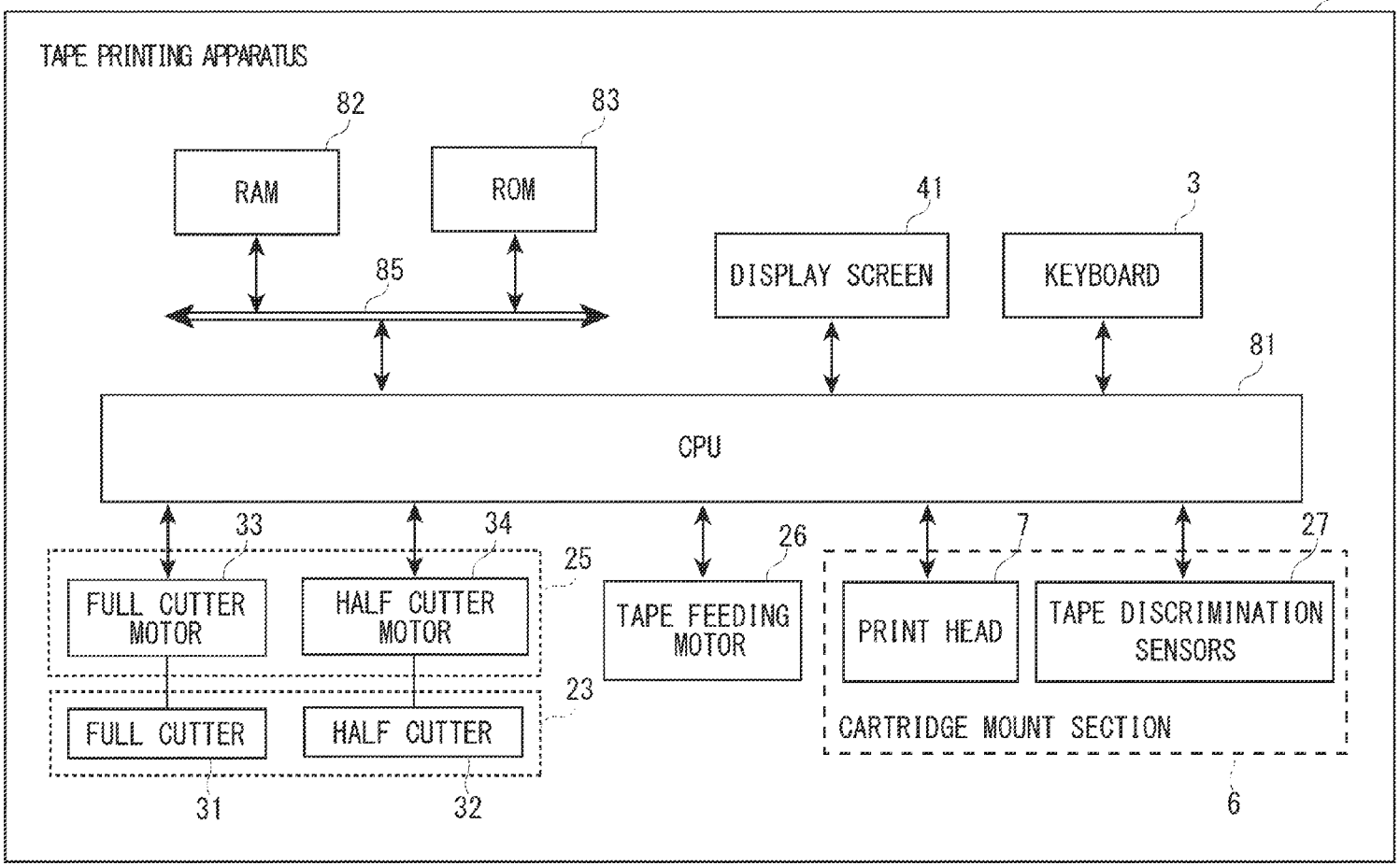
FIG. 2 is a block diagram illustrating a control structure of the tape printing apparatus.

Referring to a control block diagram of FIG. 2, a control structure of the tape printing apparatus 1 will be described. The tape printing apparatus 1 may include a CPU (Central Processing Unit) 81, a RAM (Random Access Memory) 82, a ROM (Read Only Memory) 83, the display screen 41, the keyboard 3, the cutter motor 25, the tape cutter 23, the tape feeding motor 26, the print head 7, and the tape discrimination sensors 27. The RAM 82 and the ROM 83 are connected via the CPU 81 and a bus 85, and other structure elements are directly connected to the CPU 81.

The CPU 81 is the central processing unit and forms main sections of a "dot discrimination section" and a "print data edit section". The RAM 82 is connected to the CPU 81 directly and functions as a work area when the CPU 81 performs various control. The ROM 83 stores a control program and control information with which the CPU 81 performs the various control. Specifically, a print/cut process program used for performing a print process in the print area and a cutting process, a dot presence discrimination program used for discriminating presence of print dots in a predetermined area within the print area in the marginless printing and the like (not illustrated) are stored as the control program.

The display screen 41 functions as display section for displaying the edit result and a print layout. The key board 3 functions as input section with which the user inputs information, edit section for an edit process, set section for various settings and the like.

The cutter motor 25 is connected to the tape cutter 23 and functions as cut section (cut part). The tape cutter 23 has the full cutter 31 by which the tape T is cut completely and the half cutter 32 by which only half in thickness direction of the tape T is cut. The cutter motor 25 also has the full cutter motor 33 which drives the full cutter 31 and the half cutter motor 34 which drives the half cutter 32. Only the recording tape Ta of the tape T is cut off by half cut and the tape T after the half cut is in a state that a tape piece of the cut-off recording tape Ta is adhered to the uncut peeling tape Tb.

The tape feeding motor 26 and the print head 7 function as print section which feeds the tape T and prints thereon, respectively. As explained above, the print head 7 and the tape discrimination sensors 27 are provided in the cartridge mount section 6 and the tape discrimination sensors 27 detect the type of the tape T accommodated in the tape cartridge TC. The CPU 81 limits the number of lines and the number of characters which can be input as text and discriminates whether the tape T can be cut off based on the detected result of the tape discrimination sensors 27 (based on a tape material and tape width). Further, the CPU 81 controls to drive the print head 7, the cutter motor 25 and the tape feeding motor 26 based on the print instruction.

Referring to FIGS. 3A to 8B, the normal printing and the marginless printing of the embodiment will be explained in detail. FIGS. 3A and 3B are schematic diagrams illustrating set print areas, cut positions and labels to be created in the normal printing. As illustrated in FIG. 3A, when single printing by which one label is created per one printing in the normal printing is executed, the label margin C is formed based on the above margin setting at outer sides of the front edge and the rear edge of the label image P, and an area including the label image P and the two label margins C is set as a print area A. The cut position is set at a rear edge position of the print area A. Further, as illustrated in FIG. 3B, when the continuous printing by which a plurality of same labels are printed (e.g. two labels in FIG. 3B) per one printing in the normal printing is executed, the two print areas A as the above are set. The tape printing apparatus 1 prints based on the print data and cuts at the rear edge of the print area A (a normal print/cut process). As illustrated, a plurality of labels having margins (frame) are created by the printing.

Figure 4:
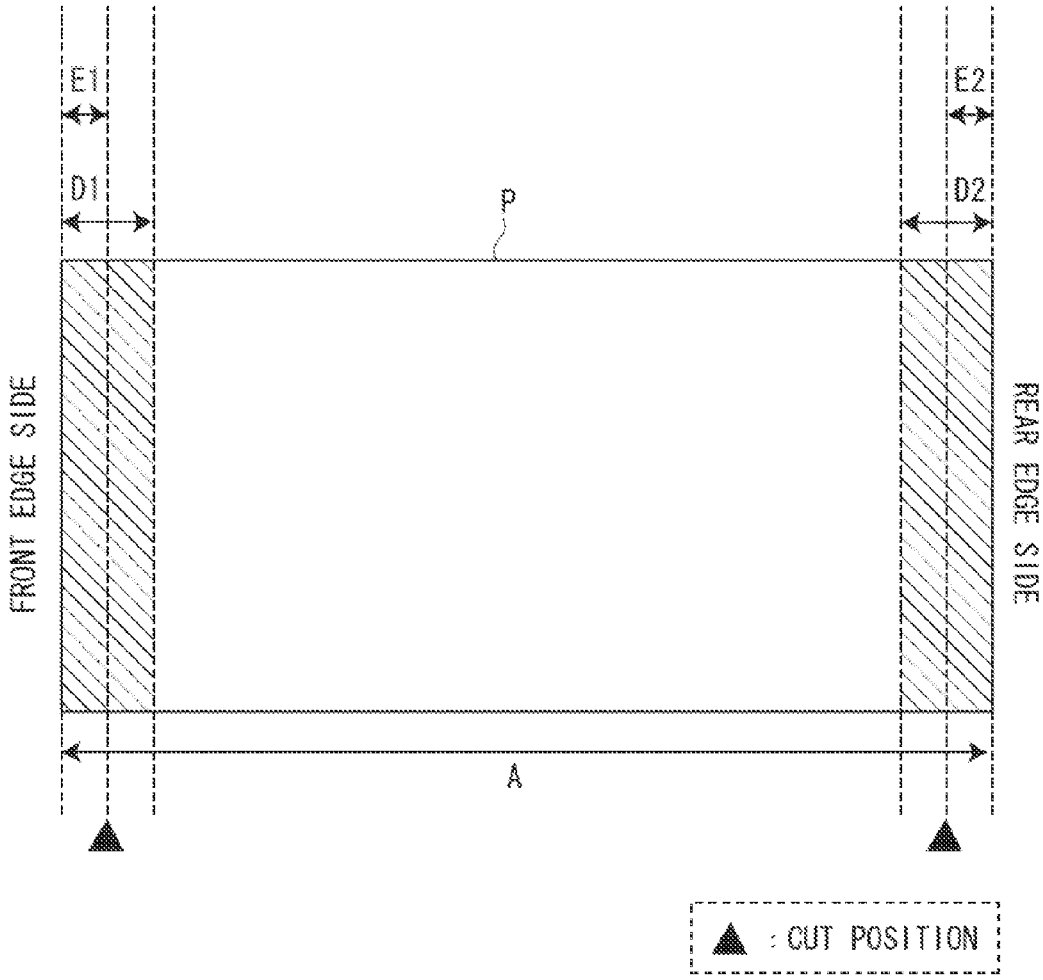
FIG. 4 is a view of discrimination target areas in the print area where presence of printing dots is discriminated therein.

Referring to FIG. 4, the print dot presence discrimination executed in the marginless printing will be explained. In the marginless printing, since the margin setting is set as the "no margin (label margin C: 0 mm), the area of the label image P is set as the print area A. Areas up to 6 mm inside from the front edge position and the rear edge position of the print area A are set as discrimination target areas D in which the presence of the print dots is discriminated. In the marginless printing, since positions at 3 mm inside from the front edge position and the rear edge position are set as cut positions, each discrimination target area D includes 3 mm areas at both sides of the presumed cut position. In the discrimination target area D, the outer portion with respect to the cut position is referred as an out-of-area E which is beyond an actual label portion. The discrimination target area D at the front edge position side is referred as a front edge discrimination target area D1 (front edge area) and the discrimination target area D at the rear edge position side is referred as a rear edge discrimination target area D2 (rear edge area). Further, the out-of-area E at the front edge position side is referred as a front edge out-of-area E1 and the out-of-area E at the rear edge position side is referred as a rear edge out-of-area E2. Predetermined length (6 mm and 3 mm) in the embodiment is arbitrary.

When in the marginless printing, the tape printing apparatus 1 discriminates whether the print dots are present in the discrimination target area D (D1, D2) with reference to the print data (the dot discrimination section). When there is no print dot at least in one of the two discrimination target areas D (D1, D2) (i.e. the print dot is not present), data on the out-of-area E (E1 and/or E2) of the discrimination target area D in which the absence of the print dot is discriminated is deleted from the print data (the print data edit section). The marginless printing is executed based on the print data thus edited. On the other hand, when even one print dot is present in both of the two discrimination target areas D (D1, D2) (i.e. the print dot is present), the marginless printing is executed without editing the print data. The print dot presence may be discriminated with reference to the predetermined number of dots as threshold whether the number of print dots in the discrimination target area D is beyond the predetermined number of dots.

FIGS. 5A to 6B are schematic diagrams illustrating the print areas and the cut positions set in the single printing of the marginless printing, and the labels to be created. FIG. 5A illustrates a case where both of the front edge discrimination target area D1 and the rear edge discrimination target area D2 are discriminated such that the dot is present. In this case, margin areas B (a front edge margin area B1 and a rear edge margin area B2) are formed at the outer sides of the front edge and the rear edge of the print area A, respectively. Length of the margin area B is longer than the distance from the tape cutter 23 to the tape ejecting slot 22 in the tape printing apparatus 1. This is to avoid that a label piece which is ejected as garbage in addition to the created label remains in the tape printing apparatus 1. The cut positions are set at three positions which are positions 3 mm inside from the front edge position and the rear edge position of the print area A, and the rear edge position of the rear edge margin area B2.

The tape printing apparatus 1 prints after providing the front edge margin area B1 at the outer side of the front edge of the print area A, and then, cuts at the position 3 mm inside from the front edge position of the print area A (a front cut process). The printing proceeds based on the print data and a predetermined position 3 mm inside from the rear edge position of the print area A is cut off (a main cut process). Afterwards, the tape printing apparatus 1 prints after providing the rear edge margin area B2 at the outer side of the rear edge of the print area A, and then, cuts at the rear edge position of the rear edge margin area B2 (a rear cut process). As illustrated, a marginless label having no margin (frame) is created by the printing. Two label pieces in total, one being a label piece on which the label image P in the front edge out-of-area El is printed and the other being a label piece on which the label image P in the rear edge out-of-area E2 is printed, in addition to the label itself, are ejected to an outside the tape printing apparatus 1.

FIG. 5B illustrates a case where both of the front edge discrimination target area D1 and the rear edge discrimination target area D2 are discriminated such that the dot is not present. In this case, data on the front edge out-of-area E1 and the rear edge out-of-area E2 is deleted from the print data, and an actual print area a is defined as a portion excluding the front edge out-of-area E1 and the rear edge out-of-area E2 from the print area A. The cut position is set at the rear edge position of the print area a. The tape printing apparatus 1 deletes the print data of each out-of-area E from the print data (both edge print data edit process), prints based on the print data and cuts the rear edge of the print area a (the normal print/cut process). As illustrated, a marginless label is created by the printing and an unnecessary label piece other than the label is not ejected.

FIG. 6A illustrates a case where only the front edge discrimination target area D1 is discriminated such that the dot is present. In this case, the data on the front edge out-of-area E1 is deleted from the print data and the actual print area a is defined as a portion excluding the rear edge out-of-area E2 from the print area A. Further, the front edge margin area B1 is provided at the outer side of the front edge of the print area a. The two cut positions are set at the position 3 mm inside from the front edge of the print area a and the rear edge position of the print area a. The tape printing apparatus 1 deletes the data on the rear edge out-of-area E2 from the print data (a rear edge print data edit process), prints after providing the front edge margin area B1 at the outer side of the front edge of the print area a, and then, cuts at the position 3 mm inside from the front edge position of the print area a (the front cut process). The printing proceeds based on the print data and the rear edge position of the print area a is cut (the normal print/cut process). As illustrated, a marginless label is created by the printing, and one label piece on which the label image P in the front edge out-of-area E1 is printed is ejected, in addition to the label itself, to the outside the tape printing apparatus 1.

FIG. 6B illustrates a case where only the rear edge discrimination target area D2 is discriminated such that the dot is present. In this case, the data on the front edge out-of-area E1 is deleted from the print data and the actual print area a is defined as a portion excluding the front edge out-of-area E1 from the print area A. Further, the rear edge margin area B2 is provided at the outer side of the rear edge of the print area a. The two cut positions are set at the position 3 mm inside from the rear edge of the print area a and the rear position of the rear edge margin area B2. The tape printing apparatus 1 deletes the print data on the front edge out-of-area E1 from the print data (a front edge print data edit process), continues to print based on the print data and cuts at the position 3 mm inside from the rear edge of the print area a (the main cut process). Then, the rear edge margin area B2 is provided at the outer side of the rear edge of the print area a and the printing is performed, and the rear edge position of the rear edge margin area B2 is cut (the rear cut process). As illustrated, a marginless label is created by the printing, and one label piece on which the label image P in the rear edge out-of-area E2 is printed is ejected, in addition to the label itself, to the outside the tape printing apparatus 1.

FIGS. 7A to 8B are schematic diagrams illustrating the print areas and the cut positions set in the continuous printing of the marginless printing, and the labels to be created. Each area corresponding to the print data of a first sheet is numbered with (1) and each area corresponding to the print data of a second sheet is numbered with (2).

Figure 7A:
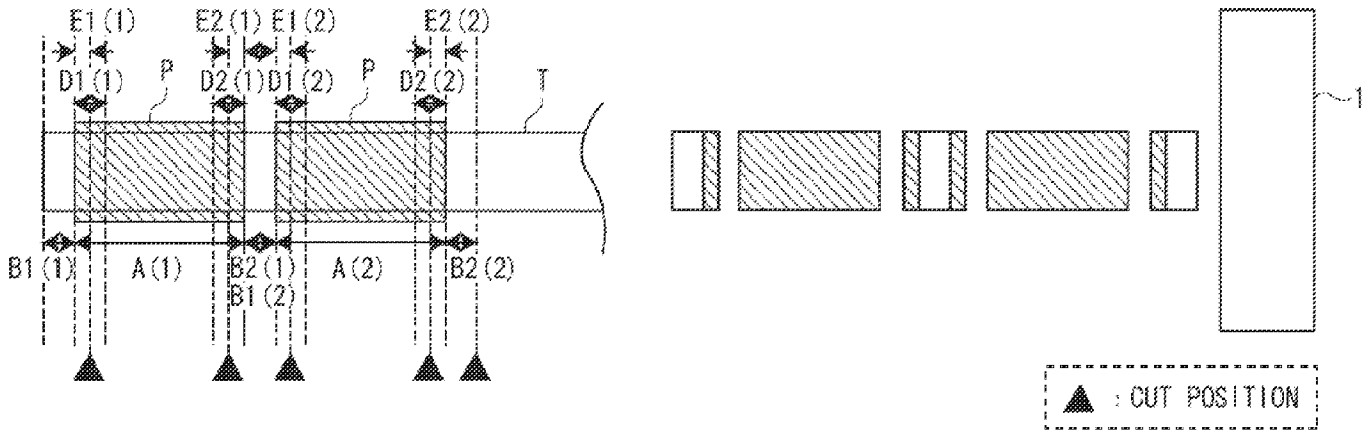
FIG. 7A illustrates views of the print areas to be set and the labels to be created when it is discriminated that the dot is present and FIG. 7B illustrates views of the print areas to be set and the labels to be created when it is discriminated that the dot is not present in continuous printing of the marginless printing schematically.

FIG. 7A illustrates a case where both areas of the front edge discrimination target areas D1 (D1 (1), D1 (2)) and the rear edge discrimination target areas D2 (D2 (1), D2 (2)) are discriminated such that the dot is present. In fact, the tape printing apparatus 1 discriminates the presence of print dots only about the front edge discrimination target area D1 (1) and the rear edge discrimination target area D2 (1) corresponding to the first sheet. In this case, the margin areas B (1) (the front edge margin area B1 (1) and the rear edge margin area B2 (1)) are provided at the outer sides of the front edge and the rear edge of the print area A (1), respectively. Likewise, the margin areas B (2) (the front edge margin area B1 (2) and the rear edge margin area B2 (2)) are provided at the outer sides of the front edge and the rear edge of the print area A (2), respectively. In this case, the rear edge margin area B2 (1) corresponding to the print data of the first sheet and the front edge margin area B1 (2) corresponding to the print data of the second sheet are provided in common. The cut positions are set at five positions which are the positions 3 mm inside from the front edge position and the rear edge position of the print area A (1), the positions 3 mm inside from the front edge position and the rear edge position of the print area A (2), and the rear edge position of the rear edge margin area B2 (2).

The tape printing apparatus 1 prints after providing the front edge margin area B1 (1) at the outer side of the front edge of the print area A (1), and cuts at the position 3 mm inside from the front edge position of the print area A (1) (the front cut process). Then, the printing proceeds based on the print data and the predetermined position 3 mm inside from the front edge position of the print area A (1) is cut (the main cut process). Thereafter, the rear edge margin area B2 (1) is provided at the outer side of the rear edge of the print area A (1) and the printing continues. The printing proceeds with the front edge margin area B2 (1) as the front edge margin area B1 (2) provided at the outer side of the front edge of the print area A (2), and the position 3 mm inside from the front edge of the print area A (2) is cut (the rear cut+the front cut processes). The printing proceeds based on the print data and the position 3 mm inside from the rear edge of the print area A (2) is cut (the main cut process). Then, the rear edge margin area B2 (2) is provided at the outer side of the rear edge of the print area A (2) to print and the rear edge position of the rear edge margin area B2 (2) is cut (the rear cut process).

As illustrated in FIG. 7A, two marginless labels are created by the printing. Three label pieces in total, that is, a label piece on which the label image P on the front edge out-of-area E1 (1) is printed, a label piece on which the label images P on the rear edge out-of-area E2 (1) and the front edge out-of-area E1 (2) are printed, and a label piece on which the label image P on the rear edge out-of-area E2 (2) is printed, are ejected to the outside the tape printing apparatus 1, in addition to the label itself.

Figure 7B:
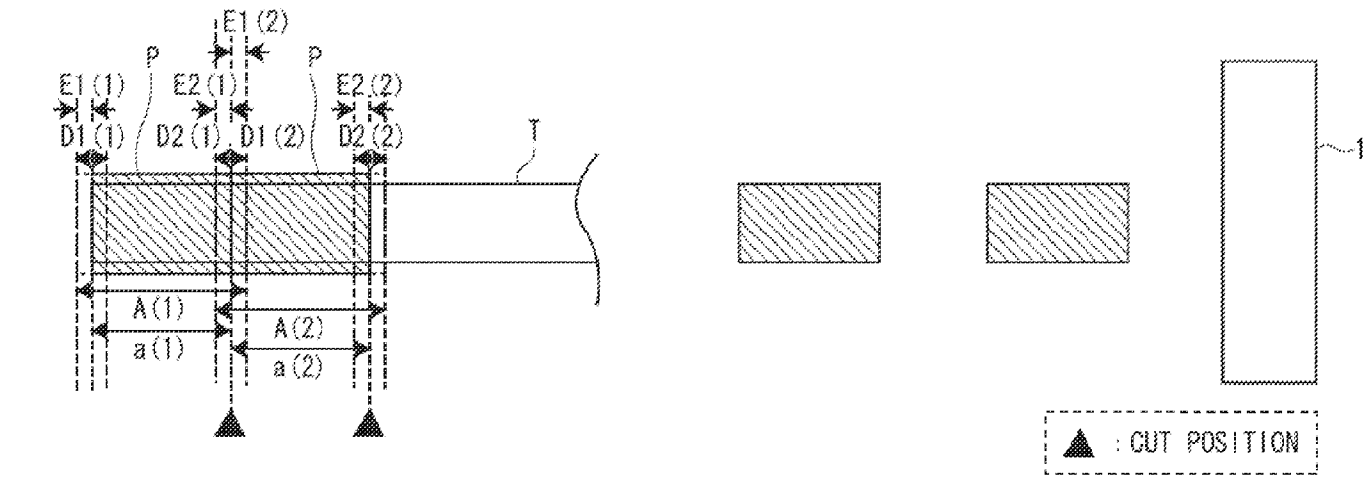

FIG. 7B illustrates a case where both the front edge discrimination target areas D1 (D1 (1), D1 (2)) and the rear edge discrimination target areas D2 (D2 (1), D2 (2)) are discriminated such that the dot is not present. In this case, the data in the front edge out-of-areas E1 (E1 (1), E1 (2)) and the rear edge out-of-areas E2 (E2 (1), E2 (2)) is deleted from the print data, thereby, a portion in which the front edge out-of-area E1 (1) and the rear edge out-of-area E2 (1) are excluded from the print area A (1) is an actual print area a (1). Likewise, a portion in which the front edge out-of-area E1 (2) and the rear edge out-of-area E2 (2) are excluded from the print area A (2) is an actual print area a (2). The cut positions are set at the rear edge position of each print area a. The tape printing apparatus 1 deletes the print data of each out-of-area E from the print data (a both edges print data edit process), prints based on the print data, and cuts at the rear edge of each print area a (the normal print/cut process). As illustrated, two marginless labels are created and an unnecessary label piece is not ejected other than the label itself.

Figure 8A:
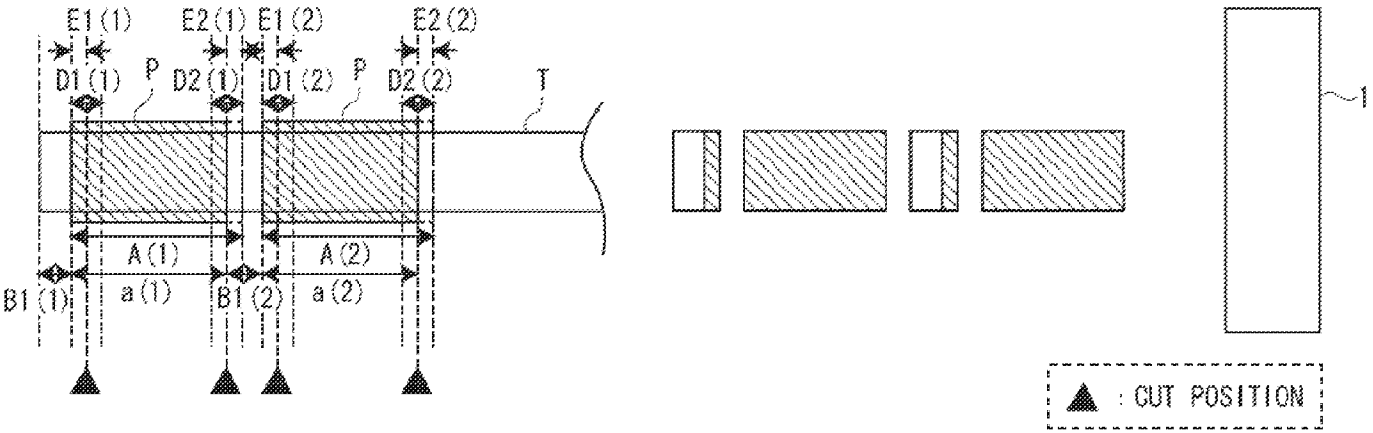
FIG. 8A illustrates views of the print areas to be set and the labels to be created when it is discriminated that the dot is present on the front edge discrimination target area and FIG. 8B illustrates views of the print areas to be set and the labels to be created when it is discriminated that the dot is not present on the rear edge discrimination target area in the continuous printing of the marginless printing schematically.

FIG. 8A illustrates a case where only the front edge discrimination target areas D1 (D1 (1), D1 (2)) are discriminated such that the dot is present. In this case, the data in the rear edge out-of-areas E2 (E2 (1), E2 (2)) is deleted from the print data, thereby, a portion in which the rear edge out-of-area E2 (1) is excluded from the print area A (1) is the actual print area a (1). Likewise, a portion in which the rear edge out-of-area E2 (2) is excluded from the print area A (2) is the actual print area a (2). Further, the front edge margin area B1 (B1 (1), B1 (2)) is provided at the outer side of the front edge of each print area a, respectively. The front edge margin area B1 (2) corresponding to the print data of the second sheet is provided from the rear edge of the print area a (1) corresponding to the print data of the first sheet. The cut positions are set at four positions which are the position 3 mm inside from the front edge of each print area a and the rear position of each print area a.

The tape printing apparatus 1 deletes the print data on the rear edge out-of-areas E2 (E2 (1), E2 (2)) from the print data (the rear edge print data edit process), and executes the front cut process and the normal print/cut process based on the print data of the first sheet. Likewise, the front cut process and the normal print/cut process are executed based on the print data of the second sheet. As illustrated in FIG. 8A, two marginless labels are created by the printing and two label pieces in total one of which is printed with the label image P on the front edge out-of-area E1 (1) thereon and the other of which is printed with the label image P on the rear edge out-of-area E1 (2) thereon respectively, are ejected to the outside the tape printing apparatus 1, in addition to the label itself.

Figure 8B:
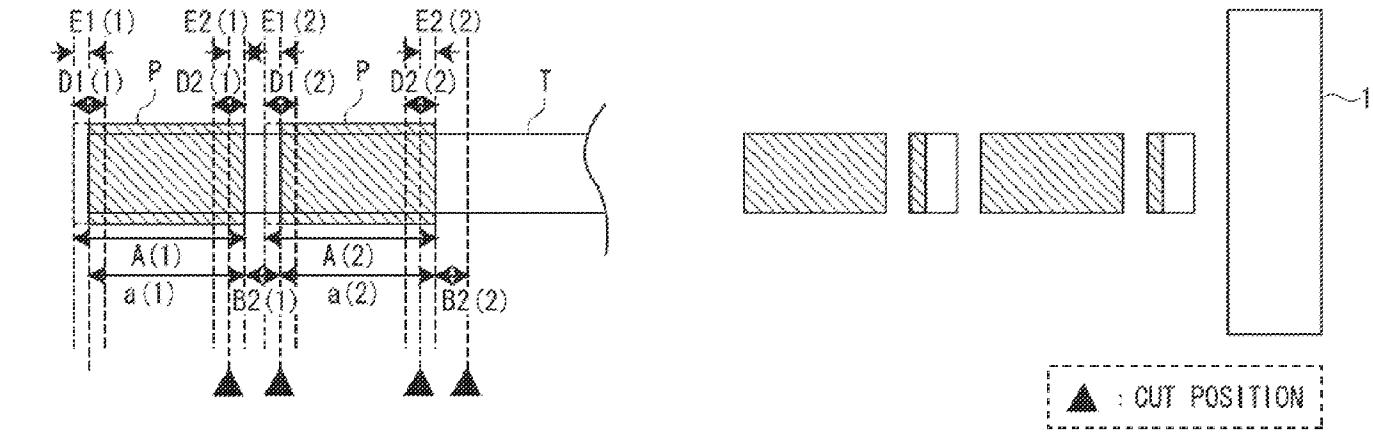

FIG. 8B illustrates a case where only the rear edge discrimination target areas D2 (D2 (1), D2 (2)) are discriminated such that the dot is present. In this case, the data in the front edge out-of-areas E1 (E1 (1), E1 (2)) is deleted from the print data, thereby, a portion in which the front edge out-of-area E1 (1) is excluded from the print area A (1) is the actual print area a (1). Likewise, a portion in which the front edge out-of-area E1 (2) is excluded from the print area A (2) is the actual print area a (2). Further, the rear edge margin area B2 (B2 (1), B2 (2)) is provided at the outer side of the rear edge of each print area a, respectively. The print area a (2) corresponding to the print data of the second sheet is provided adjacent to the outer side of the rear edge of the rear edge margin area B2 (1) corresponding to the print data of the first sheet. The cut positions are set at four positions which are the positions 3 mm inside from the rear edge of each print area a and the rear positions of each rear edge margin area B2.

The tape printing apparatus 1 deletes the print data on the front edge out-of-areas E1 (E1 (1), E1 (2)) from the print data (the front edge print data edit process), and executes the main cut process and the rear cut process based on the print data of the first sheet. Likewise, the main cut process and the rear cut process are executed based on the print data of the second sheet. As illustrated in FIG. 8B, two marginless labels are created by the printing, and two label pieces in total, one of which is printed with the label image P on the rear edge out-of-area E2 (1) thereon and the other of which is printed with the label image P on the rear edge out-of-area E2 (2) thereon respectively, are ejected to the outside the tape printing apparatus 1, in addition to the label itself.

Figure 9:
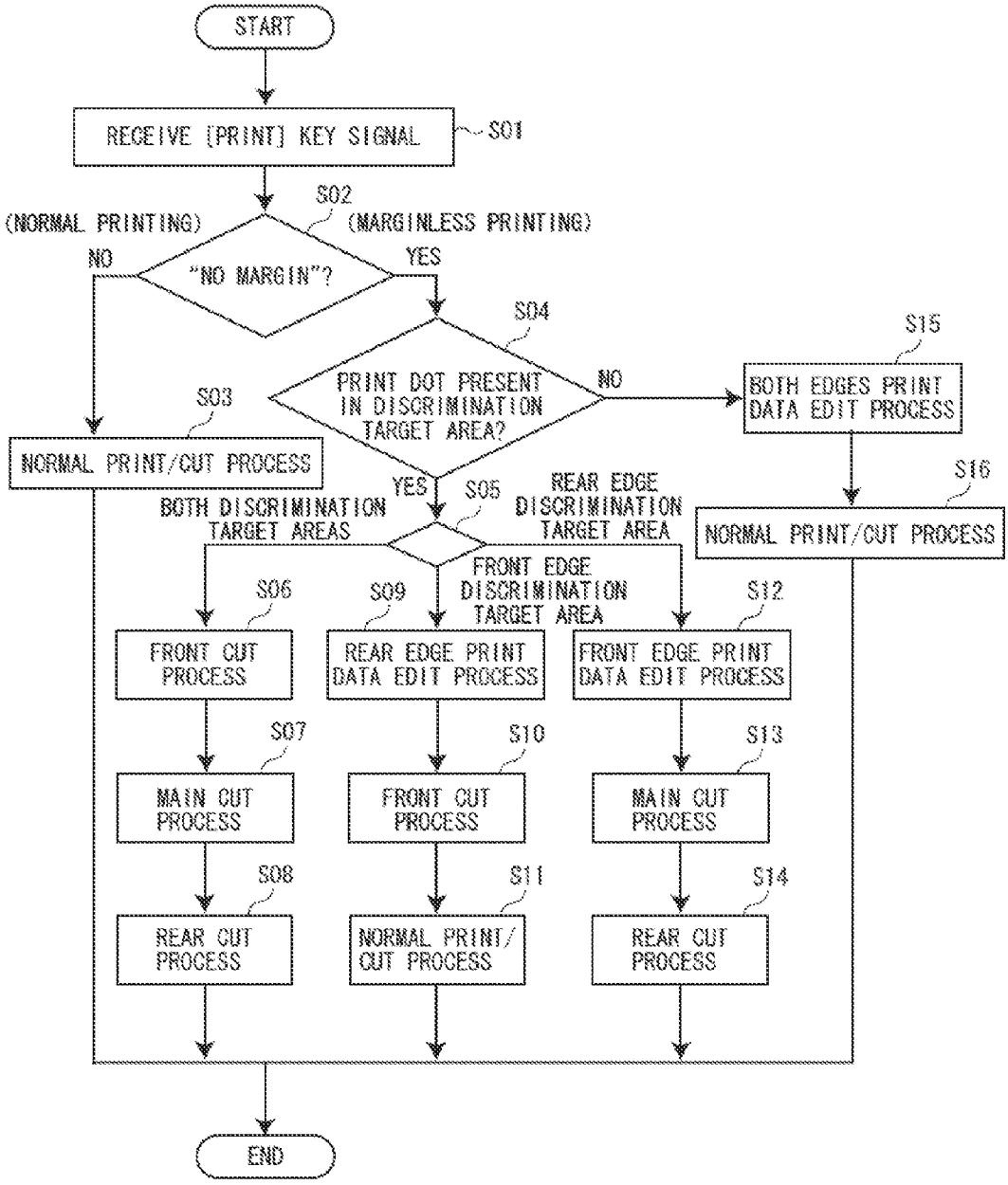
FIG. 9 is a flowchart of a print process.

Referring to a flowchart of FIG. 9, the print process of the tape printing apparatus 1 will be explained. The case in which the single printing is executed, where one label is printed per printing, will be explained. When the tape printing apparatus 1 receives the signal generated by the pressed [print] key (S01) and when the margin setting is other than the "no margin" (S02: No (the normal print)), the above normal print/cut process is executed (S03).

When the margin setting is the "no margin" (S02: Yes (the marginless printing)) and when both discrimination target areas D are discriminated such that the dot is present (S04: Yes and S05: the both discrimination target areas), the above front cut process (S06), main cut process (S07) and rear cut process (S08) are executed. On the other hand, when only the front edge discrimination target area D1 is discriminated such that the dot is present (S04: Yes and S05: the front edge discrimination target area), the above rear edge print data edit process (S09), front cut process (S10) and normal print/cut process (S11) are executed. When only the rear edge discrimination target area D2 is discriminated such that the dot is present (S04: Yes and S05: the rear edge discrimination target area), the above front edge print data edit process (S12), main cut process (S13) and rear cut process (S14) are executed.

On the other hand, when the margin setting is the "no margin" (S02: Yes (the marginless printing)) and the both discrimination target areas D are discriminated such that the dot is not present (S04: No), the above both edges print data edit process (S15) and normal print/cut process (S16) are executed.

According to the above tape printing apparatus 1, only when print dots are present around the cut position in the marginless printing, the margin area is provided at the outer side of the cut position and printing is executed, and the tape T is cut off at the cut position. Therefore, only when the printing is executed beyond or out of the print surface of the label actually created, the label piece to be garbage is generated. In other words, when the printing is not actually executed beyond or out of the print surface of the label in the marginless printing, the unnecessary label piece is not generated. Therefore, it is possible to limit a waste of tape T in the marginless printing. Further, in the embodiment, when the printing is not actually executed beyond the print surface of the label, since the data on the out-of-area E is deleted from the print data, other printing of the printing can not be incurred. In other words, the unnecessary area is not generated at the outer side of the front edge of the print area a by deleting the front edge out-of-area E, and the unnecessary area is not generated at the outer side of the rear edge of the print area a by deleting the rear edge out-of-area E.

Further, according to the above tape printing apparatus 1, since the cut position in the rear cut process is decided based on the distance from the print area A in the marginless printing, the cut position can be decided with a simple method. Still further, since the rear edge of the margin area B provided at the outer side of the rear edge of the print area A is cut off, it is possible to securely execute the rear cut at the outer side of the print area A.

The tape T which is cut at the cut position set in each printing may be executed with the half cut or the full cut. In this case, the cutting by which the area between labels (cutting in the normal print/cut process, and cutting in the main cut process and/or the rear cut process) is cut is preferable to be the full cut. Since the label piece does not remain independently in the tape printing apparatus 1 in a state that the label piece to be garbage is adhered on a mat (the peeling tape Tb) by setting the cutting as half cut, it is possible to shorten the label piece (the margin area) to a maximum extent. Therefore, it is possible to save the tape T. The cutting in the half cut may be perforation cutting by which both of the recording tape Ta and the peeling tape Tb of the tape T are cut.

The continuous printing executes to print the same print data in succession in the embodiment, but different print data may be printed consecutively. In this case, the tape printing apparatus 1 needs to discriminate whether the print dot exists in the discrimination target area D about each print data.

When the dot is present on the rear edge discrimination target area D2, whether the rear cut process should be executed may be selected depending on the mode. In this case, in the mode where the rear cut process is not executed, when previous printing is the marginless printing and the dot is present in the rear edge discrimination target area D2, it is desirable that the front cut process be executed in the normal print. In a case that the marginless printing is executed sequentially in plurality of single printing instead of the continuous printing, the label piece generated in the previous marginless printing (the dot is present in the rear edge discrimination target area D2) and the label piece generated in the next marginless printing (the dot is present in the front edge discrimination target area D1) can be in common, leading to limit the waste of the tape T.

The invention can be adapted to, for example, an ink jet type printing apparatus in addition the thermal type printing apparatus above. The sheet for printing may not be limited to the tape T but can be anything as long as the shape thereof is elongated. A structure in which the print data may be generated in an external apparatus such as a PC and the print data may be obtained by the tape printing apparatus 1 may be employed. In this case, the margin setting can be executed by the external apparatus.

Also, it may be possible to provide each structure element of the tape printing apparatus 1 as a program. Further, it may be possible to provide the program stored in a recording medium (not shown). A CD-ROM, a flash ROM, a memory card (a compact flash (trade mark), a smart media, a memory stick, etc), a compact disk, an optical-magnetic disk, a digital versatile disk, a flexible disk, and the like may be used as the recording medium.

Besides the embodiment above, as to the structure and each process of the printing apparatus 1, it may be possible to modify the invention appropriately without departing from the scope thereof.

What is claimed is:

1. A printing apparatus comprising:

a dot discrimination section configured to discriminate whether a print dot is present in a discrimination target area including a cut position at which an elongated sheet is cut in a sheet width direction, the discrimination target area being at least either one of a front edge area or a rear edge area having a predetermined length in a longitudinal direction of the sheet in a print area based on print data; and a print section configured to print after providing a margin area adjacent to an outer side of either one of the front edge area or the rear edge area where whether the print dot is present or not is discriminated when the dot discrimination section discriminates such that the dot is present, and that prints without providing the margin area when the dot discrimination section discriminates such that the dot is not present.

2. The printing apparatus according to claim 1 further comprising a cut section configured to cut the sheet in the sheet width direction at the cut position.

3. The printing apparatus according to claim 2, wherein the cut section further cuts a rear edge of the margin area provided at an outer side of the rear edge area when the rear edge area of the print area is discriminated such that the dot is present by the dot discrimination section.

4. The printing apparatus according to claim 1, wherein the print section prints continuously based on plurality of print data, and the dot discrimination section discriminates whether the dot is present in the discrimination target area in the print area based on each print data.

5. The printing apparatus according to claim 4, wherein the print section provides the margin area adjacent to adjacent discrimination target areas in common when both of the adjacent discrimination target areas are discriminated such that the dot is present by the dot discrimination section in the continuous printing.

6. The printing apparatus according to claim 1 further comprising a print data edit section configured to delete data at an outer side of the cut position of the discrimination target area in either one of the front edge area or the rear edge area discriminated such that the dot is not present from the print data when the dot discrimination section discriminates such that the dot is not present.

7. A method of controlling a printing apparatus, the printing apparatus executing steps of:

discriminating whether a print dot is present in a discrimination target area including a cut position at which an elongated sheet is cut in a sheet width direction, the discrimination target area being at least either one of a front edge area or a rear edge area having a predetermined length in a longitudinal direction of the sheet in a print area based on print data; and printing after providing a margin area adjacent to an outer side of either one of the front edge area or the rear edge area where whether the dot is present or not is discriminated when the discrimination step discriminates such that the dot is present, and printing without providing the margin area when the discrimination step discriminates such that the dot is not present.

8. The method according to claim 7 further comprising:

cutting the sheet in the sheet width direction at the cut position.

9. The method according to claim 8, wherein the cutting step further cuts a rear edge of the margin area provided at an outer side of the rear edge area when the rear edge area of the print area is discriminated such that the dot is present by the discrimination step.

10. The method according to claim 7, wherein the printing step prints continuously based on plurality of print data, and the discriminating step discriminates whether the dot is present in the discrimination target area in the print area based on each print data.

11. The method according to claim 10, wherein the printing step provides the margin area adjacent to adjacent discrimination target areas in common when both of the adjacent discrimination target areas are discriminated such that the dot is present by the discriminating step in the continuous printing.

12. The method according to claim 7 further comprising:

deleting data at an outer side of the cut position of the discrimination target area in either one of the front edge area or the rear edge area discriminated such that the dot is not present from the print data when the discriminating step discriminates such that the dot is not present.

* * * * *